US008139785B2

(12) United States Patent
Ferrill

(10) Patent No.: US 8,139,785 B2
(45) Date of Patent: Mar. 20, 2012

(54) SOUND REINFORCEMENT METHOD AND APPARATUS FOR MUSICAL INSTRUMENTS

(76) Inventor: Charles C. Ferrill, Littleton, CO (US)

( * ) Notice: Subject to any disclaimer, the term of this patent is extended or adjusted under 35 U.S.C. 154(b) by 903 days.

(21) Appl. No.: 12/214,813

(22) Filed: Jun. 23, 2008

(65) Prior Publication Data

US 2009/0316927 A1 Dec. 24, 2009

(51) Int. Cl.
*H04R 1/02* (2006.01)

(52) U.S. Cl. ..... 381/91; 381/89; 381/67

(58) Field of Classification Search ..... 381/84, 381/91, 111, 118, 120, 122, 355, 359–361, 381/365–366; 181/175, 198
See application file for complete search history.

(56) References Cited

U.S. PATENT DOCUMENTS

| | | | | |
|---|---|---|---|---|
| 3,940,576 | A | 2/1976 | Schultz | |
| 4,073,365 | A * | 2/1978 | Johnson | 181/147 |
| 4,805,728 | A * | 2/1989 | Carter et al. | 181/141 |
| 5,333,202 | A | 7/1994 | Okaya et al. | |
| 6,438,238 | B1 * | 8/2002 | Callahan | 381/67 |
| 2002/0061111 | A1 * | 5/2002 | Kulas | 381/89 |
| 2003/0112989 | A1 | 6/2003 | Jung | |

* cited by examiner

*Primary Examiner* — Marcos D. Pizarro
*Assistant Examiner* — Suian Tang

(57) ABSTRACT

A method and apparatus for sound reinforcement for musical instruments. The method and apparatus re-direct sound waves via an open-sided chamber against a curved wall panel in such a way that the sound from a musical amplifier is reflected or altered in its course from a direction in which the microphone design has reduced sensitivity to a direction of maximum sensitivity and, typically, altering the direction of the sound from off-axis to on-axis into the microphone capsule.

18 Claims, 10 Drawing Sheets

SOUND REINFORCEMENT METHOD AND APPARATUS FOR MUSICAL INSTRUMENTS

BACKGROUND AND FIELD

The following relates to microphone adapters and more particularly to a novel and improved method and apparatus for reflecting sound from off-axis to on-axis from a microphone into an amplifier for musical instruments.

Various approaches have been taken to using direct and, reflective sound to create the pickup pattern for a microphone. Typically, slots are arranged in strategic places to allow more or less direct and reflective sound to enter the capsule of the microphone. One type of microphone is the unidirectional microphone; the most common type is a cardioid response. This has full sensitivity at –0 degrees (on-axis) and is least sensitive at 180 degrees (off-axis) and is designed for live sound reinforcement. One property of the cardioid pickup pattern is that it is much less sensitive to sound from 180° off-axis so that it is possible to keep different sound sources separate but the gain and frequency response to the off-axis sound is much lower. Another phenomenon that sound engineers are concerned with is "feedback", which is sound emanating from the PA or monitor system which is then picked up by a microphone whose output is feeding that system resulting in a whining or a screeching sound. When this occurs it may damage the equipment if it is not controlled quickly. Certain microphones, such as, omnidirectional and bidirectional (FIG. 8 microphones) are more susceptible to these problems and, therefore, not used in live music situations.

Accordingly, there is a particular need for a novel and improved method and means for reflecting the sound from a musical instrument thereby enhancing the gain and frequency response and, more specifically, in such a way that the sound from a musical amplifier is reflected or altered in its course from a direction in which the microphone design has reduced sensitivity to a direction of maximum sensitivity.

SUMMARY

It is therefore desirable to provide for a novel and improved method and apparatus for enhancing the pickup pattern of a microphone and, specifically, microphones of the type having a cardioid or heart-shaped pickup pattern.

It is also a feature to provide an enhanced sound reflection method and apparatus for the amplifiers of musical instruments which is extremely compact and efficient and which is specifically designed to provide an enclosure or chamber for mounting of a microphone at the output of the amplifier for the purpose of directing the sound from the amplifier into a PA or speaker system.

A further feature of the method and apparatus is the reduction in leakage from other sound sources due to isolation from the material of the apparatus; the distance unwanted sound has to travel is greater than without the apparatus; and the desired sound is much louder, allowing a reduction in the overall gain of the mixer/amplifier.

The above features and more are accomplished with a method and apparatus comprising a sound system for at least one musical instrument wherein the musical instrument is electrically connected to an amplifier, and a microphone extends to a speaker, the improvement comprising a sound-reflecting enclosure including a curved wall panel, first means for mounting the enclosure in front of the amplifier whereby sound waves from the amplifier are directed at substantially right angles to the curved wall portion, and second means for mounting the microphone within the enclosure whereby the sound waves from the amplifier are reflected by the wall panel so as to intersect one another within the microphone.

The above advantages and features will become more readily appreciated and understood from a consideration of the following detailed description when taken together with the accompanying drawings in which:

DETAILED DESCRIPTION

Figure 1:
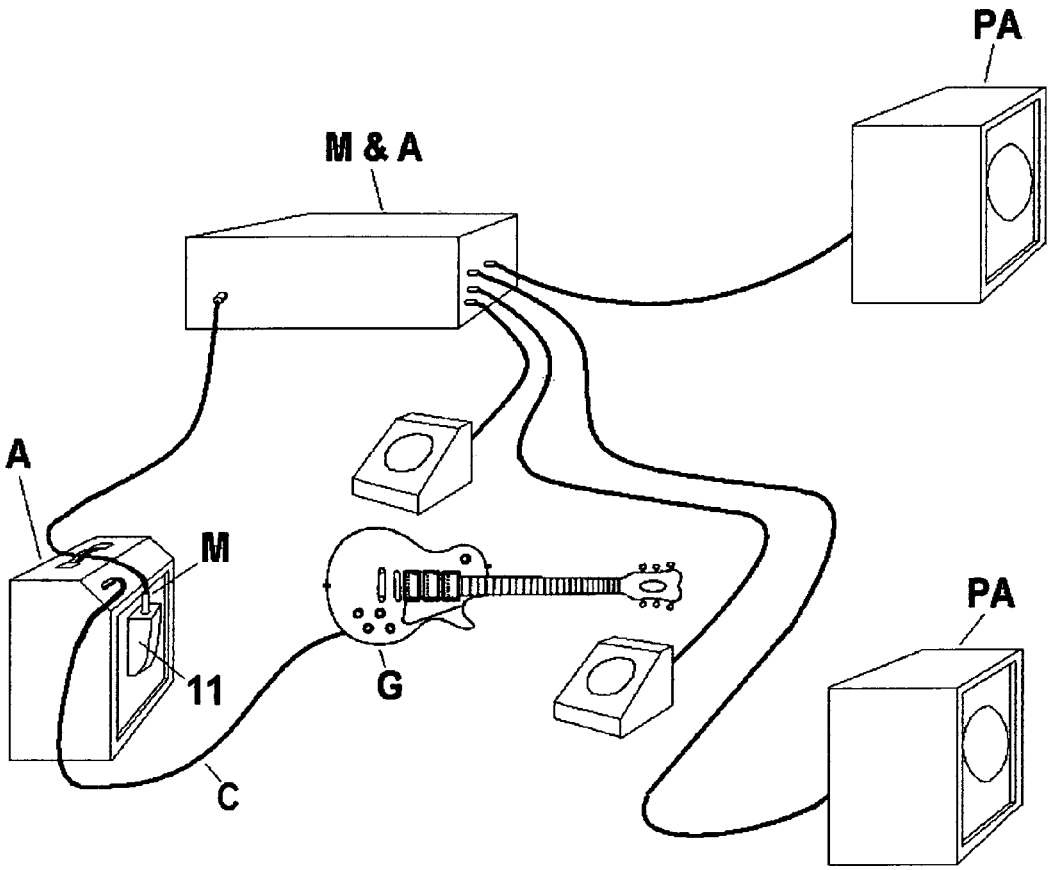
FIG. 1 is a schematic view of one embodiment of a microphone adapter.

A sound reinforcement method and apparatus is shown in FIGS. 1 through 10, and referring specifically to FIG. 1, a musical instrument such as a guitar G includes a power and sound cord C that leads to an amplifier A. An apparatus 11 is mounted on the face of the amplifier A and the sound from the guitar is reflected by the apparatus 11 into the microphone M. The sound waves detected by the microphone M are converted into electronic signals and travel from the microphone M to a Mixer and Amplifier M&A which feeds the PA speakers PA. Alternatively, the microphone M may comprise a remote wireless microphone with battery storage in the microphone neck.

Figure 4:
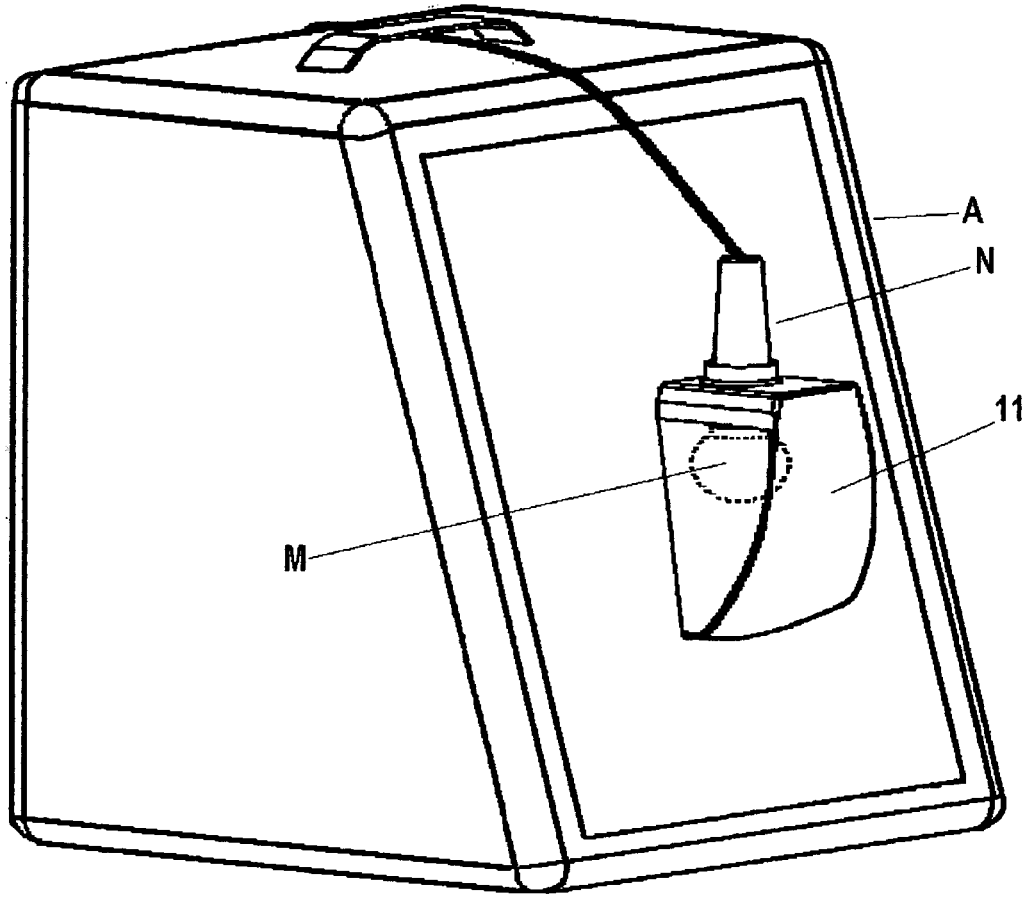
FIG. 4 is a detailed perspective view of the one embodiment of microphone adapter placed against the screen of an amplifier as schematically illustrated in FIG. 1.
Figure 5:
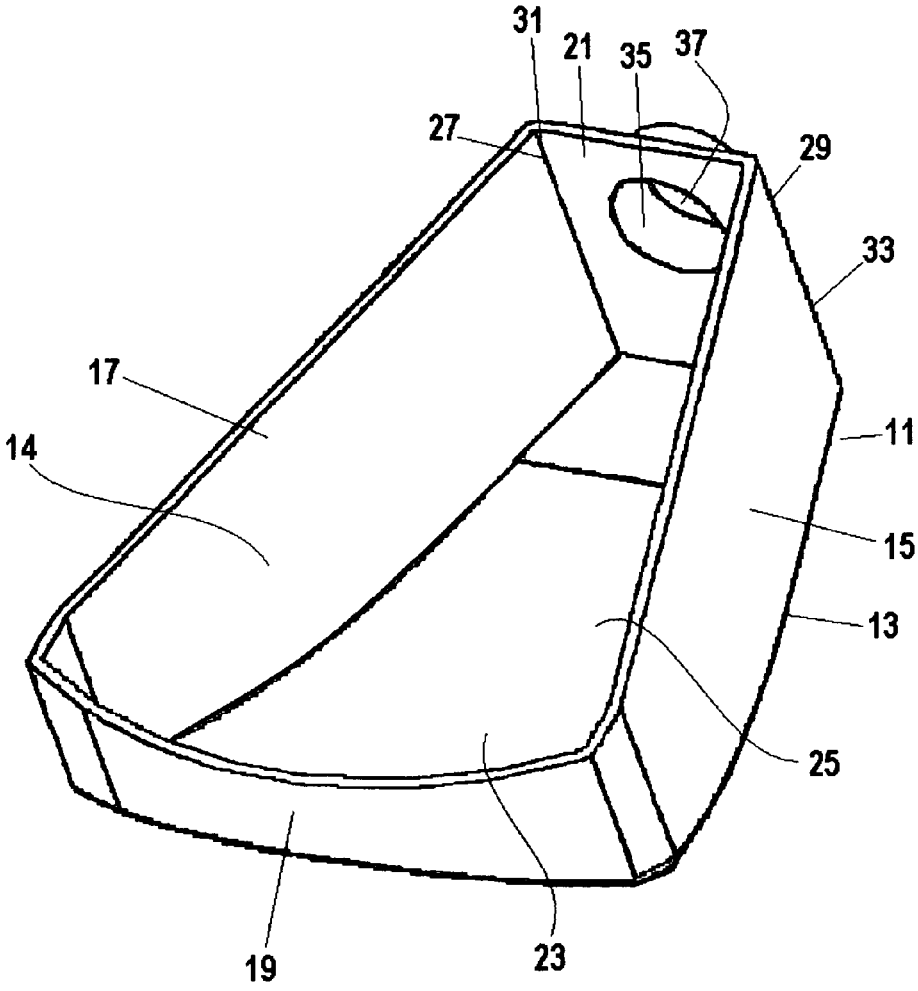
FIG. 5 is another perspective view of the sound-reflecting chamber of the microphone adapter.

The sound reinforcement apparatus 11 is broadly comprised of an oblong open-sided chamber or shell 13 having a hollow interior 14 formed by opposite side walls 15 and 17, opposite end walls 19 and 21, and an open sidewall 25 opposite to a curved wall panel 23 in direct contact with exterior edges of the opposite side walls 15, 17 and the end walls 19 and 21. The area 25 opposite the curved panel 23 remains open and is adapted to be placed or mounted on an amplifier A, as shown in FIG. 1 and FIG. 4. The apparatus 11 may be used in conjunction with a guitar amplifier as shown but may also be used with other musical instruments as well. The apparatus may be manufactured of liquid urethane or any other type of plastic material that when cured is of sufficient hardness to form a substantially rigid structure. Other materials may be used as well without departing from the scope of the apparatus. The opposite side walls 15, 17 are longitudinally aligned and exterior edges 27 and 29 are joined to exterior edges 31 and 33 of the entry panel 21 as shown in FIG. 5. The end wall 21 defines an entry panel and has a boss member or sleeve 35 in an opening 37 which is designed to accommodate a microphone M as demonstrated in FIG. 4. The boss member 35 may have different diameters but is designed to allow pass-through of a microphone neck N which tapers away from an enlarged end or head H. The boss member 35 is sized to receive the tapered neck N of the microphone in order to establish a snug frictional fit with the microphone M and to aid in positioning and supporting the head H of the microphone M within the chamber for optimum sound wave reception. The boss 35 also provides additional noise insulation and the opening 37 may be of different diameters as well.

Figure 2:
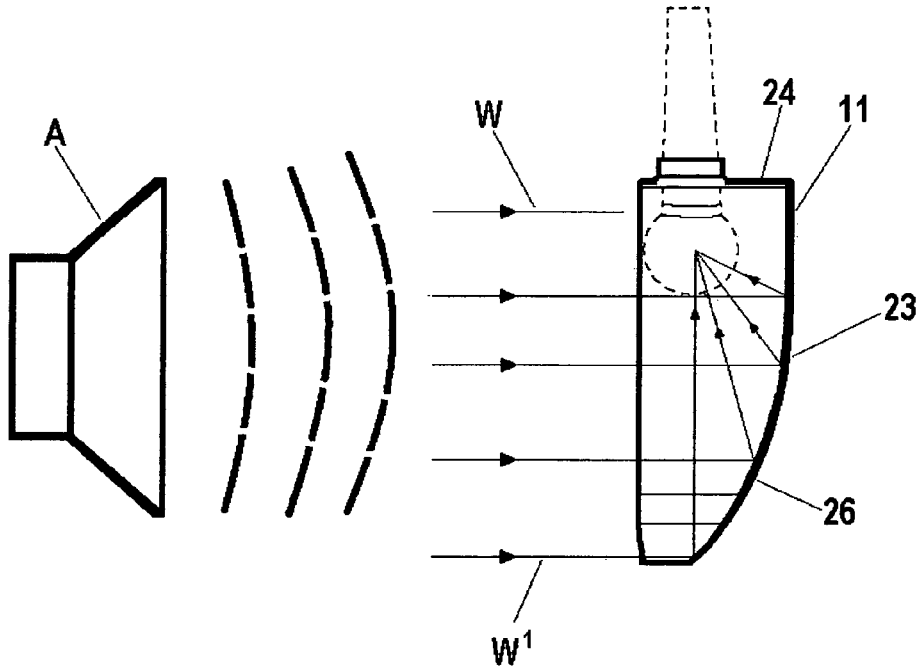
FIG. 2 is a more detailed schematic view of the one embodiment of FIG. 1 illustrating the reflection of sound into a microphone capsule.

In one form, the microphone M is oriented in a vertical plane with the sound waves W re-directed so as to intersect at a focused site within the microphone as shown in FIG. 2. The microphone may also be oriented in a horizontal plane with the sound waves directed so as to intersect along the longitudinal axis of the microphone. The alignment of the microphone and the direction of the sound waves may be varied without departing from the scope of the apparatus. The alignment of the microphone M within the apparatus 11 and the reflection of the sound waves from the amplifier A within the apparatus 11 determine the degree of sound reinforcement. The reflection of the sound waves within the apparatus 11 is determined by the curved wall panel 23.

Figure 6:
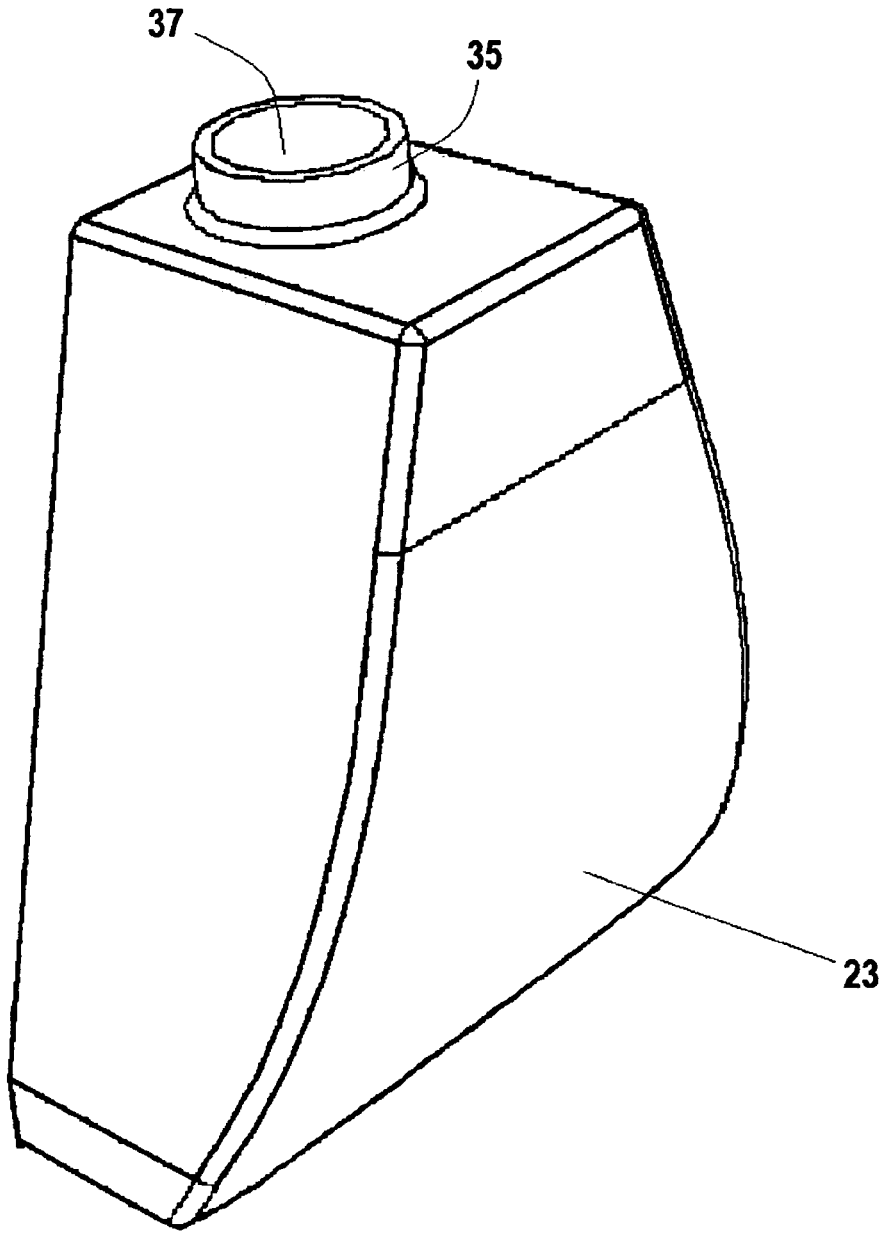
FIG. 6 is a side perspective view of the chamber illustrated in FIGS. 4 and 5.
Figure 7:
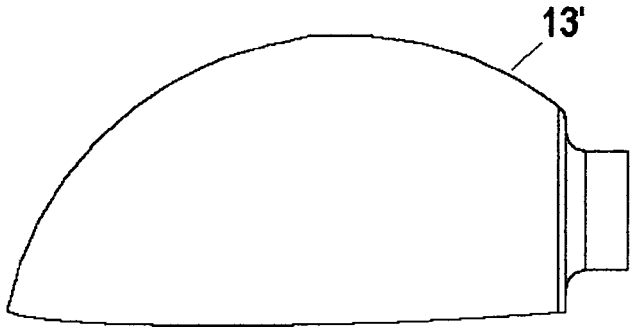
FIG. 7 is a side view of an alternate form of sound-reflecting chamber.
Figure 8:
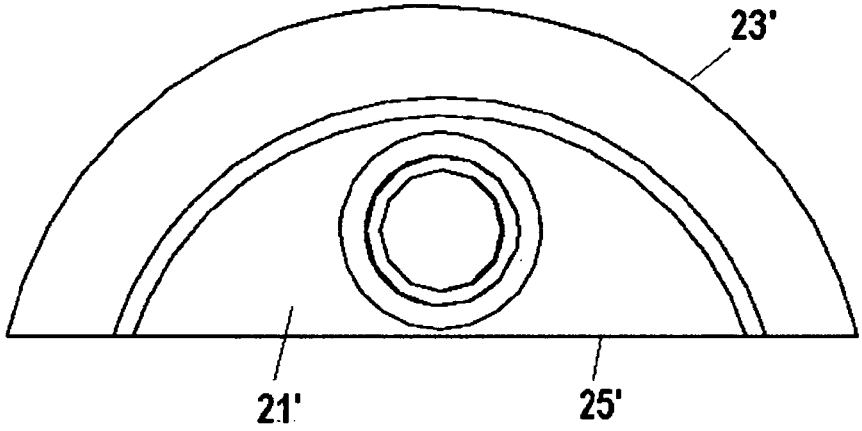
FIG. 8 is an end view of the form of chamber shown in FIG. 7.
Figure 9:
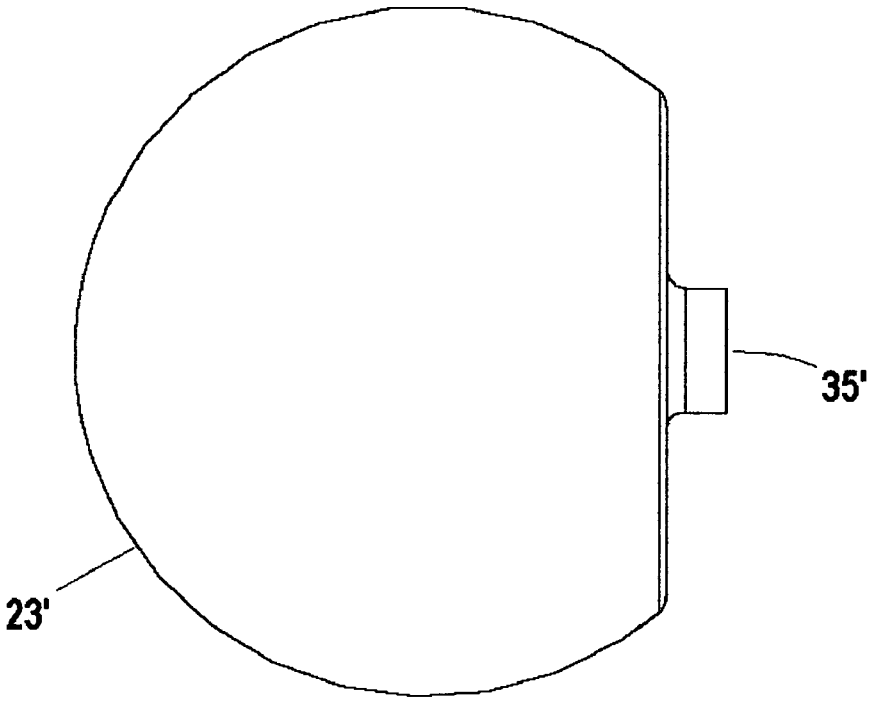
FIG. 9 is a top view of the form of chamber shown in FIG. 7.
Figure 10:
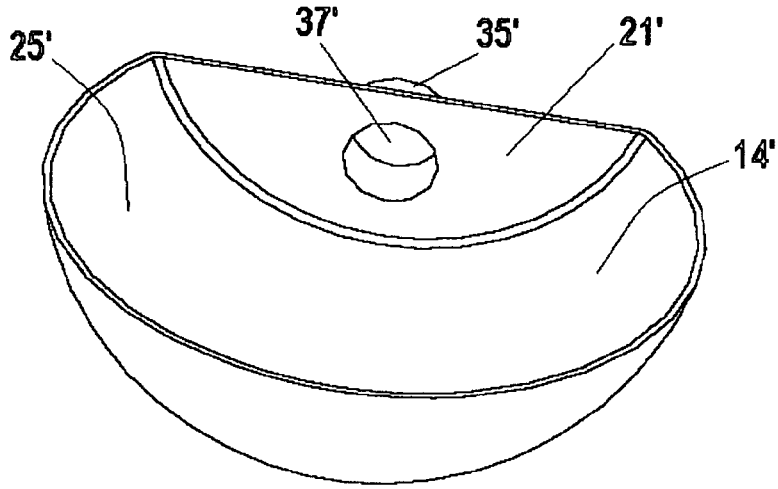
FIG. 10 is a bottom view of the form of chamber shown in FIG. 7.

The wall panel 23 as shown in FIGS. 2 and 6 is defined in one form by a modified parabolic curve which reflects sound from off-axis to on-axis for microphone reception. The wall panel 23 having a lower curved portion allows sound waves W from the amplifier to be directed at substantially right angles to the wall panel 23 as shown in FIG. 2. The sound waves W from the amplifier are then reflected by the curved wall panel to a focused site 24 within the microphone M. As is demonstrated in FIG. 2, the sound waves W' located furthest from the focused site 24 are reflected along a parallel plane to the longitudinal axis of the microphone M. As the sound waves approach the focused site 24, the curved portion 26 of the panel 23, reflects the sound waves at an angle, causing the sound waves to intersect one another at the focused site 24 within the microphone M. The sound waves are directed to the focused area of maximum sensitivity, on-axis, instead of spanning the on-axis, off-axis spectrum. As a result, the frequency and gain response will be greater. The wall panel 23 is not limited to a modified parabolic curve; other forms may be utilized without departing from the scope of the apparatus.

Figure 3:
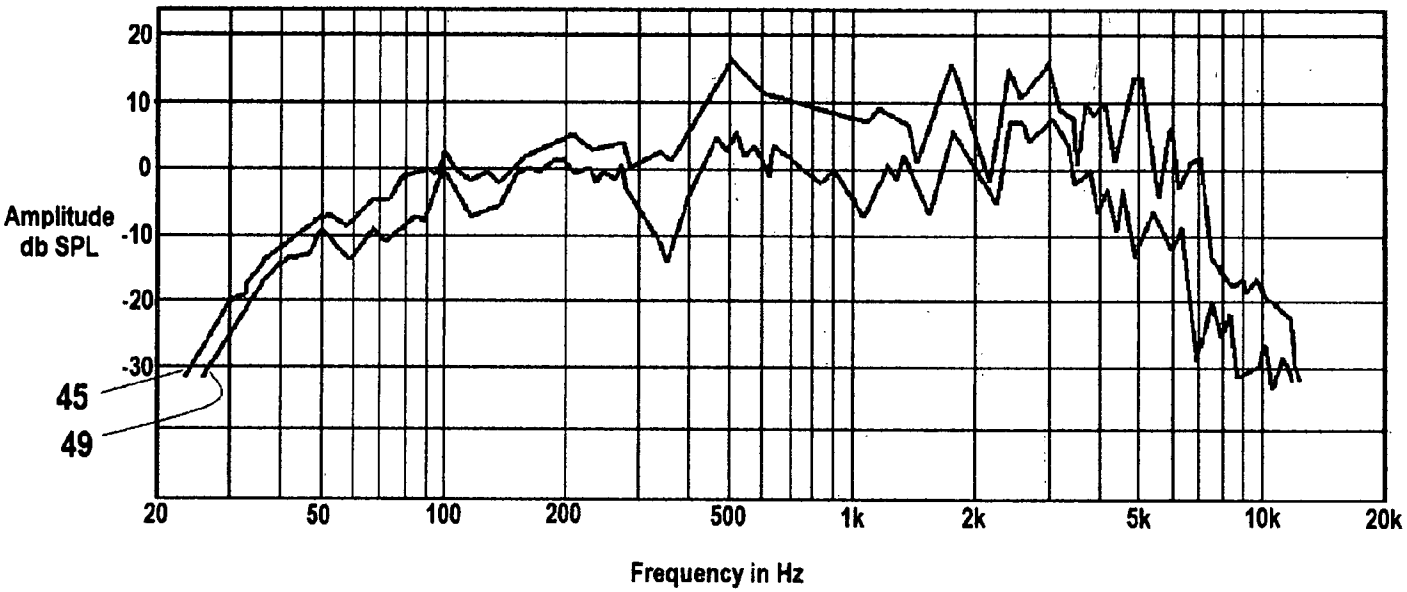
FIG. 3 is a graph illustrating the gain and frequency characteristics of the microphone adapter illustrated in FIGS. 1 and 2.

In FIG. 3, the solid line designated 45 illustrates the frequency and gain response curve to sound waves directed from a sound reinforcement device constructed in the manner of FIGS. 1 and 2. The solid line designated 49 illustrates the frequency and gain response curve for sound waves from a microphone placed directly on the surface of an amplifier. As shown in FIG. 3, line 45 indicates the increase in frequency and gain as a result of the re-direction of the sound waves to an on-axis focal point in the microphone. The lower line 49 indicates a measurement of frequency and gain with a microphone placed on the outer surface of an amplifier. The change in response is a result of re-directing sound waves from one of the directions that the design of the microphone has reduced sensitivity to a direction in which the microphone has maximum sensitivity, thereby enhancing the gain and frequency response.

The sound waves from a musical amplifier are reflected or altered in their course from a direction in which the microphone design has reduced sensitivity to a direction of maximum sensitivity and, typically, altering the direction of the sound waves from off-axis to on-axis into a microphone capsule (not shown) within the microphone M. The reflecting surface of the wall panel 23 is significant due to the angle of reflection to the focal point 24. The graph of FIG. 3 uses a program called the TrueRTA Level 4, by True Audio, Andersonville, Tenn., which is a software based audio analyzer for testing and evaluating audio systems using a PC with basic sound capability. The tests included 100 samples, averaged, sampling at 48 kHz and the graph represents the right channel and the left channel.

Another form of sound reinforcement apparatus is shown in FIGS. 7 through 10 broadly comprises an oblong enclosure or shell 13' having an internal chamber 14', opposite end wall 21', and a curved wall panel 23' in direct contact with exterior edges of the end wall 21'. An open sidewall 25' opposite the curved panel 23' allows the chamber to remain open and is adapted to be placed or mounted on an amplifier A, as shown in FIG. 1 and FIG. 4. The end wall 21' defines an entry panel and has a boss member or sleeve 35' in an opening 37' and is designed to accommodate a microphone M. The boss member 35' may be of different diameters but is designed to allow pass-through of a microphone neck N which tapers away from an enlarged end or head H. The boss member 35' is sized to receive the tapered neck N of the microphone in order to establish a snug frictional fit with the microphone M to aid in positioning and supporting the head H of the microphone M within the chamber for optimum sound wave reception. The boss 35' also provides additional noise insulation and the opening 37' may be of different diameters as well.

In a method for redirecting sound waves in a sound system from an area of minimum sensitivity to an area of maximum sensitivity, the sound reflecting enclosure 11 is mounted on the amplifier A and a'musical instrument is electrically connected to the amplifier. The microphone M is extended to the M&A, the microphone is mounted within the sound reflecting enclosure 11 and sound waves are re-directed from the amplifier A into the microphone M. The enclosure 11 has the open portion 25 for mounting the enclosure 11 in front of the amplifier A whereby sound waves from the amplifier A are directed at substantially right angles to the curved wall portion 26. The enclosure 11 is also defined by the entry panel 21 having the boss member 35 that is encircled with the sleeve 37, as described above, and is designed to accommodate the microphone M as demonstrated in FIG. 4.

Although a number of exemplary aspects and embodiments have been discussed above, those of ordinary skill in the art will recognize other modifications, permutations, additions, and sub-combinations thereof. It is therefore intended that the following appended claims and any claims hereafter introduced should be interpreted to include all such modifications, permutations, additions, and sub-combinations as are within their true spirit and scope.

I claim:

1. In a sound system for at least one musical instrument wherein said musical instrument is electrically connected to an amplifier, and a microphone extends to a mixer and amplifier, the improvement comprising:

a sound-reflecting chamber enclosure including a curved wall panel;

first means for mounting said enclosure with an open side in front of said amplifier whereby sound waves from said amplifier are directed at substantially right angles to said curved wall portion; and second means for mounting said microphone within said chamber enclosure whereby the sound waves from said amplifier are reflected by said wall Panel so as to intersect one another along a longitudinal axis of said microphone.

2. The sound system according to claim 1 wherein said curved wall panel includes a modified parabolic curved portion.

3. The sound system according to claim 1 wherein said first mounting means includes opposite side walls secured to said curved panel, an entry panel and an opposite end wall defining an open mounting area.

4. The sound system according to claim 1 wherein said second mounting means is defined by a boss member in an opening.

5. The sound system according to claim 4 wherein said boss member is sized to receive said microphone.

6. The sound system according to claim 1 wherein said curved wall panel is substantially parallel to a longitudinal axis of said microphone.

7. A sound-reflecting enclosure having a microphone mounted therein, said enclosure mounted on an amplifier, said microphone electrically connected to at least one external signal processing device, the enclosure comprising:

Opposite sidewalls secured along outside edges to an end wall and an entry panel, said opposite sidewalls secured along lower outside edges to a curved panel member;

said entry panel including means for positioning said microphone whereby sound waves from said amplifier are directed at substantially right angles to said curved panel member;

and said curved panel member adapted to reflect sound waves to a focused site within said microphone.

8. The sound-reflecting enclosure according to claim 7 wherein said curved panel member forms a approximately one-eight rotation of a parabolic curve.

9. The sound-reflecting enclosure according to claim 7 wherein said curved panel is opposite to an open mounting area.

10. The sound-reflecting enclosure according to claim 7 wherein said positioning means includes a boss member.

11. The sound reflecting enclosure according to claim 7 wherein said curved wall panel includes means for re-directing sound waves within said enclosure.

12. A sound reinforcement device defined by four side walls secured along exterior outside edges to each other and to a reflecting curved panel, said reflecting curved panel opposite to a mounting aperture, the device comprising:

means for positioning a microphone within said device whereby said microphone is aligned at an angle to sound waves from an amplifier; and means for reflecting sound waves from said reflecting curved panel whereby said sound waves are directed to a focused site within said microphone.

13. The sound reinforcement device according to claim 12 wherein said positioning means includes a noise-isolating sleeve member.

14. The sound reinforcement device according to claim 12 wherein said reflecting curved panel includes a lower curved portion.

15. A method of redirecting sound waves from an area of minimum sensitivity to an area of maximum sensitivity, the method comprising;

electrically connecting a musical instrument to an amplifier;

extending a microphone to a speaker;

mounting said microphone within a sound reflecting enclosure;

mounting said enclosure on said amplifier; and re-directing sound waves from said amplifier into said microphone.

16. The method according to claim 15 wherein said enclosure includes a curved wall panel.

17. The method according to claim 15 wherein said enclosure has a first means for mounting said enclosure in front of said amplifier whereby sound waves from said amplifier are directed at substantially right angles to said curved wall portion.

18. The method according to claim 15 wherein said enclosure is defined by second means for mounting said microphone within said enclosure whereby the sound waves from said amplifier are reflected by said wall panel parallel to the longitudinal axis of said microphone into said microphone capsule.

* * * * *